United States Patent [19]

Coraor

[11] 3,992,145

[45] Nov. 16, 1976

[54] RAPID APPLICATION AND FIXATION OF DYE OR BRIGHTENING AGENT ON SYNTHETIC POLYMER

[75] Inventor: George R. Coraor, Wilmington, Del.

[73] Assignee: E. I. Du Pont de Nemours and Company, Wilmington, Del.

[22] Filed: May 28, 1975

[21] Appl. No.: 581,567

[52] U.S. Cl. ..... 8/174; 8/94 A; 8/173; 8/176

[51] Int. Cl.[2] ..... D06P 1/68

[58] Field of Search ..... 8/174, 173, 94

[56] References Cited

UNITED STATES PATENTS

| | | | |
|---|---|---|---|
| 3,081,140 | 3/1963 | Ford | 8/4 |
| 3,255,149 | 6/1966 | Dye | 260/41.5 |
| 3,667,898 | 6/1972 | Bergman et al. | 8/94 |
| 3,900,287 | 8/1975 | Jackson | 8/174 |

FOREIGN PATENTS OR APPLICATIONS

| | | |
|---|---|---|
| 791,517 | 5/1973 | Belgium |
| 760,243 | 5/1971 | Belgium |
| 1,964,592 | 7/1971 | Germany |
| 2,002,286 | 7/1971 | Germany |
| 2,161,733 | 6/1973 | Germany |

OTHER PUBLICATIONS

Gebert, Melliand Textilberichte, 1971, 5Z (6), pp. 710–715.

Farben Revue, 1971, Special Edition 13, pp. 78–97.

*Primary Examiner*—Joseph L. Schofer

*Assistant Examiner*—A. L. Clingman

[57] ABSTRACT

Non-aqueous, atmospheric pressure, batch exhaust process for applying and fixing a disperse dye or brightening agent on a disperse dyeable synthetic polymer, for example, a polyester, in the form of a fiber, fabric or film, said process providing good exhaust and rapid fixation of dye and agent and comprising:

a. immersing the polymer in a bath containing a dispersion comprising a liquid, organic continuous phase, a dispersing agent having dispersing activity in the continuous phase and at least one member of the group consisting of disperse dye and brightening agent, said continuous phase being a non-solvent for the dye or brightening agent;

b. distillatively removing the continuous phase from the bath and replacing same, at a rate which is volumetrically proportional to the rate of removal of the continuous phase, with a liquid fluorocarbon which is miscible with the continuous phase and has a fluorine to carbon atom ratio of at least 1.5, a solubility parameter of no greater than 6.5 and a boiling point at 760 mm. pressure at least as high as the glass transition temperature (Tg) of the polymer and at least 10° C. higher than that of the continuous phase;

c. heating the polymer to at least its Tg and maintaining it at this temperature until the dye or agent is fixed on the polymer; and d. recovering polymer having dye or agent fixed thereon.

13 Claims, No Drawings

RAPID APPLICATION AND FIXATION OF DYE OR BRIGHTENING AGENT ON SYNTHETIC POLYMER

BACKGROUND OF THE INVENTION

1. Field of the Invention

The invention relates to a non-aqueous exhaust process for applying and fixing disperse dyes and/or brightening agents on synthetic polymers.

2. Description of the Prior Art

Substantial advantages in cost, energy and environmental protection may be realized by replacing water with organic liquids in the exhaust dyeing of synthetic polymers. In particular, it is recognized that the energy requirements of such processes are lower than processes employing water, due to the lower specific heats and heats of vaporization of the organic liquids. The chlorinated hydrocarbons, in particular 1,1,1-trichloroethane, trichloroethylene and perchloroethylene, have received considerable attention as organic liquid dyebath media. In order to achieve good exhaust, the dye should possess only slight solubility in the dyebath medium at dyeing temperatures. However, many commercial dyes have appreciable solubilities in the organic solvents commonly employed, thus giving low dye yields (poor exhaust). Improved dye yields have been obtained in such situations by the addition of auxiliary solvents which presumably swell the fibers and facilitate dye penetration into the fibers. Auxiliary solvents also have been employed in conjunction with base solvents in order to bring a difficultly soluble dye into solution. The auxiliary solvent is selected to have a boiling point lower than that of the basic liquid so that on distillation, during a subsequent step of the process, the auxiliary solvent can be distillatively removed, thus decreasing the solubility of the dye in the dyebath medium and improving dye yield (exhaust).

Also known in the art are solutions and dispersions of dyes in liquids of the formula R-F wherein R represents a radical selected from $FCl_2C—CFCl—$, $Cl_3C—$, $Cl_2CH—$ and $F_2ClC—CFCl—$. Such dispersions of insoluble or difficultly soluble dyes may be unstable, and it may be difficult or impossible to obtain level dyeings with such dispersions.

SUMMARY OF THE INVENTION

Non-aqueous, atmospheric pressure, batch exhaust process for applying and fixing a disperse dye or brightening agent on a disperse dyeable synthetic polymer, said process comprising:

a. immersing the polymer in a bath containing a dispersion comprising a liquid, organic continuous phase, a dispersing agent having dispersing activity in the continuous phase and at least one member of the group consisting of disperse dye and brightening agent, said continuous phase being a non-solvent for the dye or brightening agent;

b. distillatively removing the continuous phase from the bath and replacing same, at a rate which is volumetrically proportional to the rate of removal of the continuous phase, with a liquid fluorocarbon which is miscible with the continuous phase and has a fluorine to carbon atom ratio of at least 1.5, a solubility parameter of no greater than 6.5 and a boiling point at 760 mm. pressure at least as high as the glass transition temperature (Tg) of the polymer and at least 10° C. higher than that of the continuous phase;

c. heating the polymer to at least its Tg and maintaining it at this temperature until the dye or agent is fixed on the polymer; and d. recovering polymer having dye or agent fixed thereon.

DETAILED DISCUSSION OF THE INVENTION

The process is useful with any synthetic polymer which is normally dyeable with disperse dyes, for example, polyesters, polyamides, cellulose acetate and cellulose triacetate; it is also useful with certain acrylic polymers. It is particularly useful with polyesters, such as polyethylene terephthalate. It can be used to dye such synthetic polymers which are blended with a second component, such as cotton or wool, for example, blend fabrics of such materials, without effecting dyeing of the second component. The process can be used to dye or treat with brightening agent synthetic polymers in any form but it is generally employed with such polymers in the form of fabrics, fibers or films.

The process of this invention, as summarized above, provides good exhaust and rapid fixation of disperse dye or brightening agent. Relatively common continuous phase materials and dispersants are employed. A significant feature of this invention resides in the discovery that there can be employed a readily available continuous phase, wherein the dispersant exhibits dispersing activity, for applying to and distributing the dye or agent onto the polymer. The continuous phase is then distillatively removed, thus being available for recycling, and replaced with the higher boiling and poorer solubilizing liquid fluorocarbon, wherein the dispersant may not exhibit dispersing activity, and rapid fixation is effected. After fixation is complete and the polymer has been removed from the bath, the fluorocarbon also is available for recycling.

The continuous phase must be a non-solvent for the dye or brightening agent, it must be miscible with the liquid fluorocarbon and it must have a boiling point (at 760 mm. pressure) which is at least 10° C. less than that of the liquid fluorocarbon employed in the fixation step. More specifically, the dye or brightening agent should be substantially insoluble in the continuous phase, that is, have a solubility at 25° C. of less than 0.01 weight %. Preferred liquid organic continuous phases include those having a solubility parameter of 7.0 – 8.2.

Solubility parameter, a measure of the solvency power of a material, is employed herein to characterize not only the preferred continuous phase materials but all the liquid fluorocarbons which will be described hereinafter. Solubility parameter is discussed, for example, in "The Solubility of Nonelectrolytes" by Joel H. Hildebrand and Robert L. Scott, 3rd edition, Reinhold Publishing Corp., New York, New York, 1950, and by H. Burrell in Journal of Paint Technology 27, 726 (1955). It is known that materials having widely different solubility parameters are immiscible with each other. The disperse dyes and brightening agents employed in this invention, because they contain polar groups, have relatively high solubility parameters (at least 10). The preferred continuous phase materials herein have a solubility parameter of 7.0 – 8.2. A solubility parameter of 8.2 corresponds to the solvency power of cyclohexane. A preferred continuous phase herein is 1,1,2-trichloro-1,2,2-trifluoroethane; it has a solubility parameter of 7.2. If the solubility parameter of the continuous phase exceeds about 8.2, some care may have to be exercised in the selection of dye or brightening agent since many dyes and brightening agents may be soluble in materials of such high solvency power. Moreover, such continuous phase may be imbibed or dissolved in the polymer and additional efforts may be required to ensure removal thereof from the polymer as the continuous phase is being replaced by the liquid fluorocarbon. As an example of such as a continuous phase, tetrachloroethylene (perchloroethylene) having a solubility parameter of 9.4 is operable herein with certain dyes and brightening agents which are substantially insoluble therein. If the solubility parameter of the continuous phase is less than about 7.0, the more common dispersants which are operable herein may not have the required dispersing activity and more expensive and unusual dispersants may be required.

The solubility parameter of a material can be calculated from the equation $$\delta = \left[\frac{\Delta H - RT}{V}\right]^{1/2}$$

where $\delta$ is the solubility parameter, in (cal./cc.)$^{1/2}$, $\Delta H$ is the heat of vaporization per mole, $R$ is the gas constant, T is the absolute temperature and $V$ is the volume per mole, all in consistent units. $\Delta H$, if not already known, is readily determined by standard methods. $V$, if not known, is easily calculated from the density of the compound by dividing it into the molecular weight.

The continuous phase generally may be selected from aliphatic and naphthenic hydrocarbons and halohydrocarbons or halocarbons. Azeotropes of halocarbons, wherein the halocarbon comprises a major weight fraction, also are operable. Table 1 includes a list of materials, with the solubility parameters in parentheses, which may be employed herein as the continuous phase.

TABLE 1

1. 1,1,2-Trichloro-1,2,2-trifluoroethane (7.2)
2. Trichlorofluoromethane (7.5)
3. n-Hexane (7.2)
4. 1,1,1-Trichloro-2,2,3,3,3-pentafluoropropane (6.4)
5. Cyclohexane (8.2)
6. 1,1,2,2-Tetrachloro-1,2-difluoroethane (7.9)
7. 1,2-Dichloroperfluorocyclobutane (6.5)
8. Petroleum ether (about 7.6)
9. Tetrachloroethylene (9.4)
10. Azeotrope of (1) and methylene chloride (about 8.6)
11. Azeotrope of (1) and acetone (about 8.3)
12. Azeotrope of (1) and ethanol (about 7.5)
13. Mixtures of aliphatic and naphthenic hydrocarbons of low aromatic content (7.5 – 8.0)
14. Methylcyclohexane (7.8)
15. 2,3-Dichloroperfluoro-n-butane (6.5)
16. Trichloroethylene (9.3)

As indicated above, the dispersants employed herein are relatively common dispersants and should exhibit dispersing activity in the continuous phase; that is, they are characterized by solubility to an effective degree in the continuous phase. Operable dispersants include the titanium acylates wherein the acyl group contains about twelve to about twenty carbon atoms. The acylates are polytitanic acid derivatives which are prepared according to processes which are well known and described in the prior art, for example, U.S. Pat. No. 2,621,195. The compounds are conveniently prepared from a titanium ortho ester, such as a tetraalkyl titanate, for example, tetraisopropyl titanate. The ester is reacted with about two moles of water and one mole of an aliphatic carboxylic acid $RCO_2H$, per atom of titanium, and a mixed acylate of polytitanic acid is formed; it contains repeat units of the formula

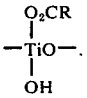

In order that the polytitanic acid acylates have adequate solubility in the continuous phase, the aliphatic carboxylic acid should contain at least about 12 carbon atoms. It serves no useful purpose to exceed about 20 carbon atoms. Based on these limitations R in the above formulas is 11–19.

Other dispersants useful herein are the alkaline earth salts of sulfurized alkylated phenates. These can be conveniently prepared by well known processes which are included in the prior art, for example, U.S. Pat. No. 2,680,097. In brief, an alkylphenol, such as cetyl- or amylphenol, is reacted with an alkaline earth salt, such as calcium oxide, in ethylene glycol, and thereafter with sulfur, at an elevated temperature; the desired product contains about 0.6–12 wt. % calcium and about 1–4 wt. % sulfur.

Another type of dispersant which is useful herein are the alkaline earth petroleum sulfonates. These can be prepared by sulfonating a petroleum distillate and thereafter neutralizing the sulfonated material with an alkaline earth hydroxide, such as calcium hydroxide. Such materials, and processes for their preparation, are well known in the prior art, for example, U.S. Pat. No. 1,330,624.

Many alkaline earth salts of sulfurized alkylated phenates and alkaline earth petroleum sulfonates are commercially available either as a solution or as a dispersion in neutral oil. The oil does not adversely affect their usefulness in this invention.

Still another type of dispersant which is useful herein includes compounds comprising one or more molecular segments of each of the types A and B and, optionally, C, segment A having a molecular weight of at least about 1,000 and being selected from the group consisting of $F[CF(CF_3)CF_2O]_nCF(CF_3)$— and monovalent radicals of polyacrylic esters, polymethacrylic esters and polyalkylenes, segment B being selected from the organic functional groups carboxy, carbamoyl, ureido, amino, lower alkylated amino, hydroxy and 2-oxopyrrolidinyl and segment C being a connecting polyvalent radical, joining segments A and B, which radical contains a moiety selected from the group consisting of sulfides, amides, imides, esters, phosphonates and thiophosphonates. The polyacrylic and polymethacrylic esters referred to above are known esters of polyacrylic or polymethacrylic acid and a $C_{1-20}$ aliphatic alcohol, the polyalkylenes referred to are known olefin polymers of $C_{2-12}$ hydrocarbon monomers, preferably $C_{2-4}$ monomers, and $n$ in the perfluorinated polyethers referred to is 6–40, preferably 6–9. As indicated, the C segment polyvalent radical connects A and B. One end of the polyvalent segment is attached to A or B through the aforesaid sulfide, amide, imide, ester, phosphate or thiophosphonate moiety. It is to be understood that segment C may contain other moieties, which other moieties are critical only to the extent that there is provided another valence radical for chemically bonding segment C to A or B as the case may be. The nature of segment C can be more fully understood from a consideration of such segments which are listed in Table 2 which illustrates the above definition by including a listing of the segments A, B and C of dispersants which are operable herein. Table 3 lists dispersants containing the segments shown in Table 2. Their identifying numbers correspond to the identifying numbers in Table 2. Some of the dispersants shown are readily available commercially and are sold in oil-like vehicles for ease in handling. The vehicles are without effect in the instant invention. Dispersants exemplified may be mixtures as a result of their derivation from, for example, natural products, petroleum fraction intermediates or a distribution of oligomers. The repeat unit formula subscripts shown in Tables 2 and 3 include the number average of the distribution thereof, reflecting the composition of such mixtures. Oligomerization is random.

TABLE 2

| A | Mol. Wt. A | B | C |
|---|---|---|---|
| 1. $H[CH_2C(CH_3)(CO_2(CH_2)_{12}H)]_{17}-$ $-[CH_2C(CH_3)(CO_2CH_3)]_{12}-$ $-[CH_2CH(CO_2C_2H_5)]_{10}-$ | 6,500 | $-COOH$ | $-S(CH_2)_2O_2CNH(CH_2)_6N$ $[CONH(CH_2)_6NHCOSCHCH_2]_2$ |
| 2. $H[CH_2C(CH_3)(CO_2CH_3)]_{23}-$ $-[CH_2-CH(CO_2CH_2CH(C_2H_5)(CH_2)_4H)]_9-$ | 3,960 | $-NHCONH_2$ | $-S(CH_2)_2O_2CNH(CH_2)_6N$ $[CONH(CH_2)_6-]_2$ |
| 3. $H[CH_2C(CH_3)(CO_2CH_3)]_{34}-$ $-[CH_2-CH(CO_2CH_2CH(C_2H_5)(CH_2)_4H)]_{13}-$ | 5,800 | $-NHCONH_2$ | $-S(CH_2)_2O_2CNH(CH_2)_6N$ $[CONH(CH_2)_6-]_2$ |
| 4. $H[CH_2C(CH_3)(CO_2(CH_2)_4H)]_{633}-$ $-[CH_2C(CH_3)(CO_2C_{12-18}H_{25-37})]_{181}-$ $-[CH_2-CH]_{67}H$ | 140,000 | $[-NCO(CH_2)_3-]_{67}$ | None |
| 5. $H[CH_2C(CH_3)_2]_{24}-CH=C(CH_3)CH_2-$ | 1,400 | $-NH_2$ | $-CH-CO$ $N-(CH_2CH_2NH)_3CH_2CH_2-$ $CH_2-CO$ |
| 6. $H[CH_2-C(CH_3)_2]_{26}-$ | 1,450 | $-OH$ | $-P(S)(OH)OCH_2CH_2-$ |
| 7. $F[CF(CF_3)CF_2O]_{24}-CF(CF_3)-$ | 4,200 | $-CO_2H$ | None |
| 8. $F[CF(CF_3)CF_2O]_{32}-CF(CF_3)-$ | 5,300 | $-NH_2$ | $-CONHCH_2CH_2-$ |
| 9. $F[CF(CF_3)CF_2O]_{37}-CF(CF_3)-$ | 6,300 | $-NH_2$ | $-CONH(-CH_2CH_2NH-)_2CH_2CH_2-$ |
| 10. $H[CH_2C(CH_3)CO_2(CH_2)_4H]_{101}-$ $[CH_2C(CH_3)(CO_2C_{15}H_{31})]_{113}-$ $[CH_2C(CH_3)(CO_2CH_2CH_2)]_{11}H$ | 26,000 | $[-N(CH_2CH_3)_2]_{11}$ | None |

TABLE 3

1. $H[CH_2C(CH_3)(CO_2(CH_2)_{12}H)]_{17}-[CH_2C(CH_3)(CO_2CH_3)]_{12}-$ $[CH_2CH(CO_2C_2H_5)]_{10}-S(CH_2)_2O_2CNH(CH_2)_6N[CONH(CH_2)_6NH-$ $COSCH(CO_2H)CH_2CO_2H]_2$
(disclosed in prior art)
2. $H[CH_2C(CH_3)(CO_2CH_3)]_{23}-[CH_2CH(CO_2CH_2CH(C_2H_5)(CH_2)_4H)]_9-$ $S(CH_2)_2O_2CNH(CH_2)_6N[CONH(CH_2)_6-NHCONH_2]_2$
(disclosed in prior art)
3. $H[CH_2C(CH_3)(CO_2CH_3)]_{34}-[CH_2CH(CO_2CH_2CH(C_2H_5)(CH_2)_4H)]_{13}-$ $S(CH_2)_2O_2CNH(CH_2)_6N[CONH(CH_2)_6-NHCONH_2]_2$
(disclosed in prior art)
4. $H[CH_2C(CH_3)(CO_2(CH_2)_4H)]_{633}-[CH_2C(CH_3)(CO_2C_{12-18}H_{25-37})]_{181}-$ $[CH_2-CH(NCH_2CH_2CH_2CO-)]_{67}$
(commercially available)
5. $H[CH_2C(CH_3)_2]_{24}-CH=C(CH_3)CH_2-CH-CO$ $N-(CH_2CH_2NH)_3CH_2CH_2-NH_2$ $CH_2-CO$
(commercially available)
6. $H[CH_2-C(CH_3)_2]_{26}-P(S)(OH)OCH_2CH_2OH$
(commercially available)
7. $F[CF(CF_3)CF_2O]_{24}-CF(CF_3)-COOH$
(disclosed in prior art)
8. $F[CF(CF_3)CF_2O]_{32}CF(CF_3)CONHCH_2CH_2NH_2$
(disclosed in prior art)
9. $F[CF(CF_3)CF_2O]_{37}CF(CF_3)-CONH(CH_2CH_2NH)_2CH_2CH_2NH_2$ TABLE 3-continued

| | |
|---|---|
| 10. | $H[CH_2C(CH_3)CO_2(CH_2)_4H]_{101}-[CH_2C(CH_3)(CO_2C_{15}H_{31})]_{113}-[CH_2C(CH_3)(CO_2CH_2CH_2N(CH_2CH_3)_2)]_{11}-H$ |

As already indicated, the liquid fluorocarbon must be miscible with the continuous phase, have a fluorine to carbon atom ratio of at least 1.5, have a solubility parameter of not greater than 6.5 and have a boiling point, at 760 mm. pressure, which is at least as high as the glass transition temperature (Tg) of the polymer and at least 10° C. higher than that of the continuous phase. Preferably, the fluorine to carbon atom ratio is at least 2.0. The boiling point should be at least as high as the glass transition temperature of the polymer to facilitate fixation of the dye or brightening agent on the polymer. Reference herein to fixation on the polymer is intended to include fixation in the polymer. More specifically, no distinction is intended between surface fixation and fixation throughout the polymer, as may be realized when the dye or brightening agent diffuses into the polymer and is fixed therein. Furthermore, in referring to the use of a liquid fluorocarbon in the fixation step, as opposed to the use of a continuous phase in the application step, it is not intended to exclude the use of certain compounds designated herein as liquid fluorocarbons from use as the continuous phase. However, each use has separate requirements, which requirements are such that the same compound or material cannot be used as the continuous phase and as the liquid fluorocarbon fixant, that is, in the step wherein the polymer is heated to at least its glass transition temperature.

The remaining constituents, that is, other than fluorine and carbon, of the liquid fluorocarbon are usually hydrogen atoms, other halogens, particularly chlorine atoms, or heteroatoms, in particular, ether oxygen or tertiary amine nitrogen atoms. There are numerous, known, useful liquid fluorocarbons which are operable herein. These include the following, with the solubility parameters being given in parentheses if they have been measured or calculated: perfluoroaliphatic and perfluorocycloaliphatic hydrocarbons, such as perfluoro(dimethylcyclobutane) (5.6), and perfluoropentane; perfluorokerosene constituents, such as perfluorotetradecane; perfluoroethers, such as perfluoro(N-propylmorpholine) (6.0), perfluoro(2-butyltetrahydrofuran), perfluoro(2-propyltetrahydropyran); the hexafluoropropylene oxide polymers having molecular weights as high as several thousand, such as $F[CF(CF_3)CF_2O]_nCHFCF_3$ (5.5–6.5) and $F[CF(CF_3)CF_2O]_nCF_2CF_3$, n being an integer, preferably at least 3; and perfluoro(trialkylamines), such as perfluoro(tributylamine). Also included are chlorofluoroalkanes, such as 1,2-dichloroperfluorocyclobutane (6.5), 2,3-dichloroperfluorobutane (6.5), 2,2- or 2,3-dichloroperfluoropropane (6.3), 2,2,3-trichloroperfluorobutane (7.0), 1-chloroperfluorodecane and 1-chloroperfluorododecane. The above listing is not intended to be complete. Any fluorocarbon or mixture of fluorocarbons having the required properties is meant to be included. Fluorocarbons which are not useful herein because they are not normally liquids and/or have solubility parameters which are too high are tetrafluoromethane, chlorotrifluoromethane, dichlorodifluoromethane, trichlorofluoromethane (solubility parameter greater than 7.0), chlorodifluoromethane, hexafluoroethane, chloropentafluoroethane, 1,1,2-trichloro-1,2,2-trifluoroethane (solubility parameter 7.2) and octafluorocyclobutane. In general, unsaturated fluorocarbons, that is, fluorocarbons containing a

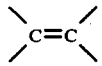

moiety, are excluded or undesirable because of their reactivities, especially with free amino groups, such as often are present in disperse dyes, and because they often are highly toxic. However, it has been found that such unsaturated fluorocarbons which have three or four perfluoroalkyl groups of 1–10 carbon atoms, preferably 1–3 carbon atoms, attached to the

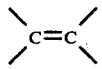

moiety are useful herein because they are substantially non-reactive.

Table 4 provides physical data on some liquid fluorocarbons which are useful in the invention.

TABLE 4

| Fluorocarbon | Boiling Point (° C.) | Solubility Parameter |
|---|---|---|
| $F(CF(CF_3)CF_2O)_nCHFCF_3$ | | |
| n = 2 | 104 | 5.5 |
| n = 3 | 152 | 5.4 |
| n = 4 | 194 | 5.2 |
| n = 5 | 224 | 4.9 |
| n = 6.3 average | 238 | 4.6 |
| perfluoro(1-methyldecalin) | 160 | 6.4 |
| perfluoro(dimethylcyclohexane) | 102 | 6.1 |
| perfluorooctane | 100–105 | 5.7 |
| perfluoro(tributylamine) | 180 | 5.6 |
| perfluoroundecane | 161 | 5.9 |
| 1-chloroperfluorononane | 150 | 6.0 |

The process of this invention can be carried out in the presence of conventional dye carriers and dye accelerators. Their use may provide higher dye and/or color value yields. Dye carriers are compounds which are soluble in the polymer under dyeing conditions, lowering the polymer's glass transition temperature, loosening the polymer structure and increasing dyeing rate. The effective dyeing temperature can be lowered by the use of a carrier. Examples of compounds which serve as dye carriers herein include n-butyl benzoate, p-hydroxybenzoic acid and 2-phenoxyethanol. Dyeing accelerators differ from carriers in that, generally, they are not absorbed by the polymer but improve dye distribution on the polymer surface, providing a dyeing with improved tinctorial strength. Triethyleneglycol and diethyleneglycol monomethyl ether are examples of useful dye accelerators. Solubility in the continuous phase and insolubility in the liquid fluorocarbon are desirable properties for a dye carrier and a dye accelerator. Generally, a dye carrier or dye accelerator is used at a concentration of about 1–5 weight %, based on the weight of the polymer.

The instant process is useful in the application and fixing of disperse dyes and brightening agents. Both classes of compounds are characterized by lack of water solubilizing groups, by solubility in polymers such as cellulose acetates, polyacrylates, polyamides and polyesters and by insolubility in the continuous phase and in the liquid fluorocarbon. In the practice of this invention disperse dyes and brightening agents are considered equivalent. Table 5 includes disperse dyes which are of various chemical classes and which are operable in the instant invention.

TABLE 5

| | | Color |
|---|---|---|
| 1) | 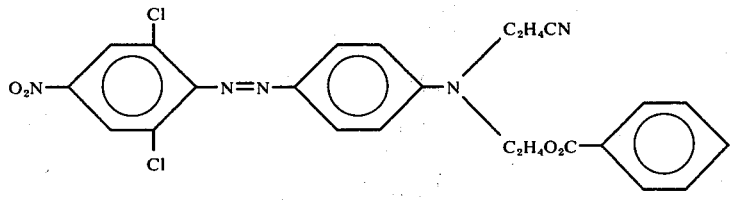 | brown |
| 2) | 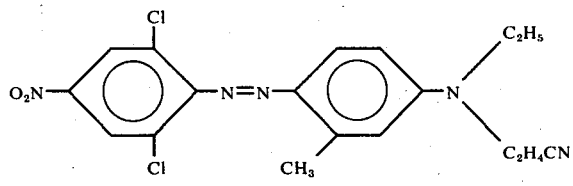 | brown |
| 3) | 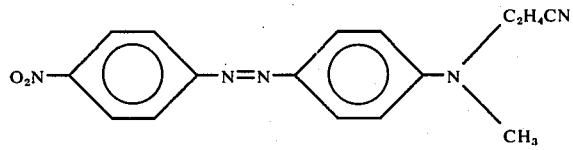 | orange |
| 4) | 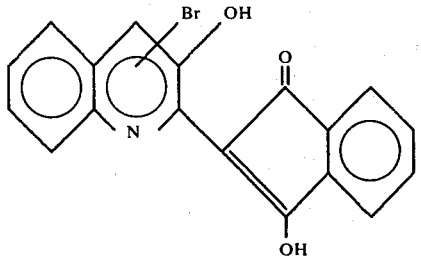 | yellow |
| 5) | 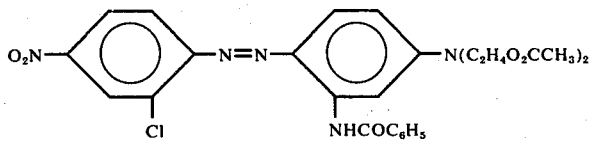 | red |
| 6) | 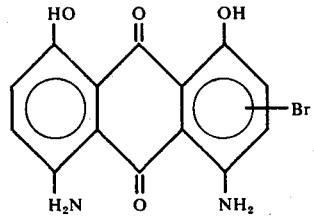 | blue |
| 7) | 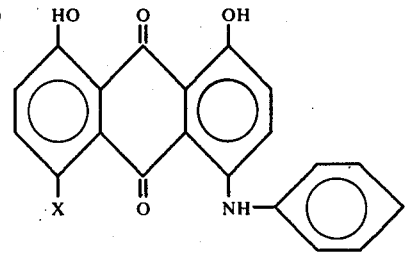 | blue |

TABLE 5-continued
| | Color |
|---|---|
| X = $NO_2$ or 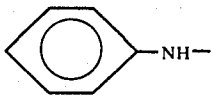 | |
| 8) 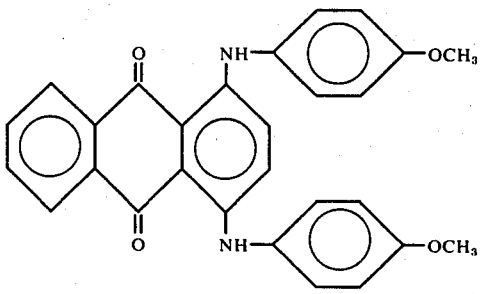 | blue |
| 9) 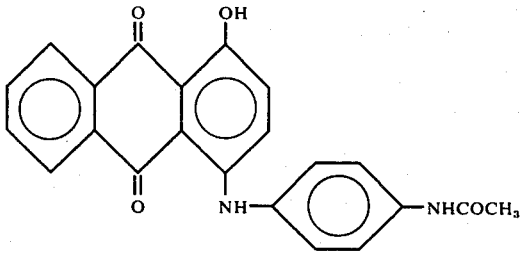 | blue |
| 10) 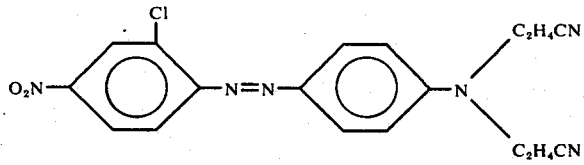 | orange |
| 11) 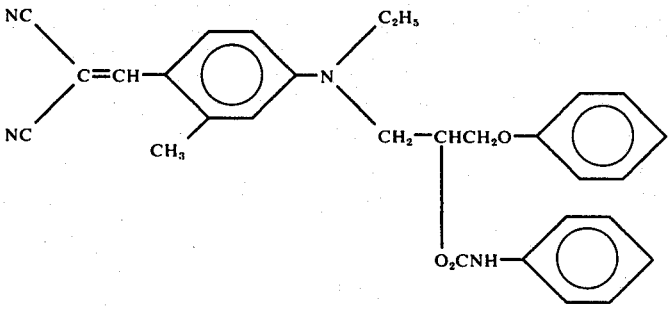 | yellow |
| 12) 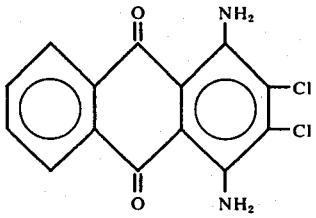 | violet |
| 13) 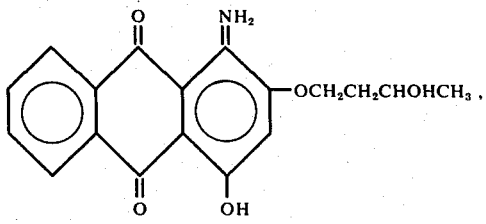 | cerise |

TABLE 5-continued

| | | Color |
|---|---|---|
| 14) | 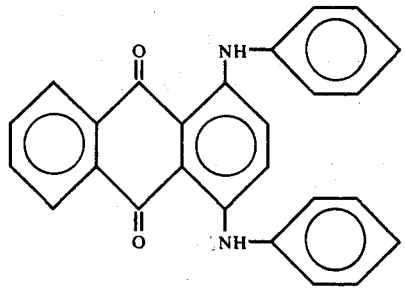 | violet |
| 15) | 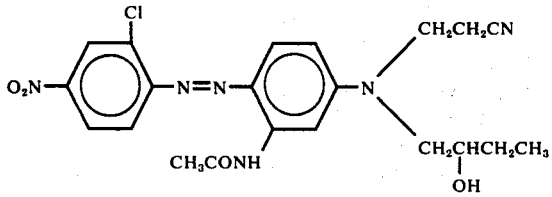 | red |
| 16) | 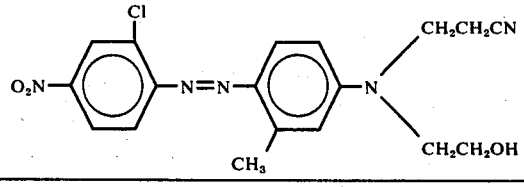 | red |

Examples of brightening agents, also called fluorescent whitening agents, which are operable herein include 1,2-bis(2-benzimidazolyl)ethylene and 7-dimethylamino-4-methylcoumarin. These examples are not intended as limiting on the numbers and types of compounds that can be employed herein as brightening agents.

Known means can be employed to obtain a dispersion of disperse dye or brightening agent for use in the application step. If it is desirable to employ a dispersion of high stability, the average particle size of the dye or brightening agent should not exceed about 5 microns. Although colloid mills can be employed to reduce the particles to this size, it is preferred to use well-known sand-milling techniques, such as are employed in the preparation of aqueous dye pastes. It is preferred to sand-mill the dye or brightening agent in the presence of the dispersant and an amount of liquid sufficient to permit efficient milling. The liquid can be the same as the continuous phase or it can be different so long as it is miscible therewith. In this way can be formed a concentrate which, on dilution with continuous phase, provides a dispersion of treatment bath strength. Since the volume of any non-continuous phase liquid employed in the sand-milling step is small relative to the final volume of the continuous phase, such non-continuous phase is without substantial effect on the properties of the continuous phase.

EXAMPLES 1–34

Table 9 exemplifies the dyeing of textile fibers in the form of various knits and woven fabrics according to the invention process as described hereinabove. Dye concentrates were prepared by sand-milling in a concentrate liquid identified by number in the Table 9 column entitled "Conc. Liq. No.". The number correspond to the liquids listed by number in Table 6. If the concentrate was dried to remove the concentrate liquid and to provide a redispersible powder, the concentrate liquid is identified as "O" in Tables 6 and 9. The concentrates were diluted with continuous phases identified by number in the Table 9 column entitled "Cont. Phase No.". The numbers correspond to the continuous phases listed by number in Table 1. The amount of dye employed is shown in the Table 9 column entitled "O.W.F. (wt. %)", O.W.F. being on weight of fabric. The dipersant is identified by number in the Table 9 column entitled "Dispersant No." The numbers correspond to the dispersants listed by number in Table 7. Carriers, when used, were employed in the liquid fluorocarbon at a concentration of 2–3 weight % (O.W.F.). Carriers and accelerators are identified by number in the Table 9 column entitled "Carrier No.". The numbers correspond to the carriers and accelerators listed by number in Table 8. The liquid fluorocarbon employed is identified by formula in Table 9. Several processes of dyeing were employed. Dyeing of yarn packages, indicated by "pkg." in the "Process" column of Table 9, was carried out in a conventional laboratory size dyer, such as described in American Dyestuff Reporter 43, 392 (1954). Beam dyeing, indicated by "beam" in the "Process" column of Table 9, was simulated by wrapping fabric around a 1.9 cm. diameter perforated steel tube fitted into the dyer in place of a yarn package. A flask containing the dispersion-liquid fluorocarbon mixture and a mechanical stirrer to which a fabric sample was attached demonstrated another means of dyeing, designated "flask" in the Process column of Table 9. In still another process, fabrics were tumbled with the dye mixture in a heated drum; this process is designated "drum" in the Process column of Table 9.

TABLE 6

Concentrate Liquids

0. None (redispersible powder)
1. 1,1,2-Trichloro-1,2,2-trifluoroethane
2. Mineral spirits
3. Methylcyclohexane
4. Ligroin
5. Cyclohexane
6. Tetrachloroethylene

TABLE 7

Dispersants

1. $H[CH_2C(CH_3)(CO_2CH_3)]_{23}$-$[CH_2CH(CO_2CH_2CH(C_2H_5)(CH_2)_4H)]_9$-$S(CH_2)_2O_2CNH(CH_2)_6N[CONH(CH_2)_6NH$-$CONH_2]_2$

2. 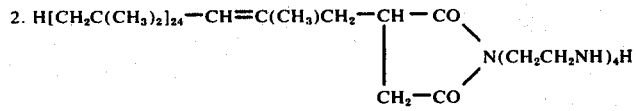

TABLE 8

0. None
1. 2-Phenoxyethanol
2. Triethylene glycol
3. Butyl benzoate
4. p-Hydroxybenzoic acid

TABLE 9

| Ex. No. | Dye No. | O.W.F. (wt. %) | Conc. Liq. No. | Cont. Phase No. | Parts (wt.) | Dispersant No. | Carrier No. | * | Parts (wt.) | Polymer | Parts (wt.) | Process | Time (min.) | Temp. (° C.) | Results |
|---|---|---|---|---|---|---|---|---|---|---|---|---|---|---|---|
| 1 | 1 | 0.25 | 1 | 1 | 2025 | 1 | 0 | 1 | 2500 | polyester yarn | 50 | pkg. | 30 | 150 | excel. exhaust, level |
| 2 | 2 | 0.7 | 0 | 1 | 2100 | 3 | 0 | 1 | 2500 | " | 50 | " | 30 | 150 | good exhaust, level |
| 3 | 3 | 0.5 | 1 | 1 | 2100 | 1 | 0 | 1 | 2500 | " | 50 | " | 30 | 135 | excel. exhaust, level |
| 4 | 3 | 0.5 | 1 | 1 | 2100 | 1 | 0 | 1 | 2500 | double-knit polyester | 50 | beam | 30 | 135 | excel. exhaust, level |
| 5 | 3 | 0.6 | 1 | 1 | 2100 | 1 | 4 | 1 | 2500 | polyester yarn | 50 | pkg. | 30 | 135 | excel. exhaust, strong, level |
| 6 | 4 | 0.5 | 1 | 1 | 2100 | 1 | 0 | 1 | 2500 | " | 50 | " | 30 | 135 | good exhaust, level |
| 7 | 5 | 0.6 | 1 | 1 | 2100 | 1 | 0 | 1 | 2500 | double knit ribbed polyester | 50 | beam | 30 | 135 | good exhaust, level |
| 8 | 6<br>7<br>8<br>3 | 0.1<br>0.35<br>0.4<br>0.2 | 1 | 1 | 2100 | 2 | 0 | 1 | 2500 | double knit ribbed polyester | 50 | " | 30 | 135 | good black dyeing, level, good exhaust |
| 9 | 3 | 0.6 | 1 | 1 | 2100 | 1 | 0 | 1 | 2500 | polyester/cotton 1:1 twill | 50 | " | 30 | 135 | polyester dyed; cotton reserved |
| 10 | 9<br>10 | 0.35<br>0.04 | 1 | 1 | 2100 | 2 | 0 | 1 | 2500 | polyester double knit, flat | 50 | beam | 30 | 150 | level navy blue good exhaust |
| 11 | 4<br>10<br>8<br>6 | 0.09<br>0.10<br>0.11<br>0.10 | 1 | 1 | 2100 | 2 | 0 | 1 | 2500 | double knit ribbed polyester | 50 | " | 30 | 150 | olive green, level, good exhaust |
| 12 | 11 | 0.5 | 1 | 1 | 2100 | 2 | 0 | 1 | 2500 | polyester double knit blister fabric | 50 | " | 30 | 135 | good exhaust, level |
| 13 | 13 | 0.4 | 1 | 1 | 2100 | 2 | 0 | 1 | 2500 | polyester/wool fabric | 50 | " | 30 | 135 | good exhaust, level |
| 14 | 3 | 0.5 | 4 | 1 | 2100 | 3 | 0 | 1 | 2500 | polyester double knit, flat | 50 | " | 30 | 135 | good exhaust, level |
| 15 | 9 | 0.25 | 1 | 1 | 3500 | 1 | 0 | 1 | 3400 | polyester double knit, flat | 49 | flask | 45 | 135 | good exhaust, level |
| 16 | 3 | 0.5 | 1 | 1 | 900 | 1 | 0 | 1 | 400 | polyester knits. | 61 | drum | 30 | 139 | excel. exhaust, strong, level |
| 17 | 5 | 0.25 | 1 | 1 | 600 | 1 | 0 | 1 | 350 | double and warp knit polyester | 40 | " | 34 | 145 | excel. exhaust, strong, level |
| 18 | 9 | 0.25 | 1 | 1 | 2100 | 1 | 1 | 1 | 2100 | polyester double knit, flat | 50 | beam | 30 | 135 | excel. exhaust, strong, level |
| 19 | 9 | 0.25 | 1 | 1 | 2100 | 1 | 2 | 1 | 2100 | polyester double knit, flat | 50 | beam | 30 | 135 | excel. exhaust, strong, level |
| 20 | 9 | 0.25 | 1 | 1 | 2100 | 1 | 3 | 1 | 2100 | polyester double knit, flat | 50 | " | 30 | 135 | excel. exhaust, strong, level |
| 21 | 10<br>5<br>6 | 0.32<br>0.01<br>0.89 | 3 | 1 | 2100 | 2 | 0 | 1 | 2500 | polyester double knit | 50 | " | 30 | 150 | good exhaust dark navy blue |
| 22 | 4 | 0.5 | 4 | 2 | 2100 | 3 | 0 | 1 | 2500 | polyester double knit | 50 | | 30 | 150 | excel. exhaust, strong, level |
| 23 | 4 | 0.5 | 3 | 3 | 594 | 3 | 0 | 2 | 1550 | polyester double knit, flat | 25 | flask | 30 | 135 | fair exhaust, level |
| 24 | 3 | 0.4 | 1 | 4 | 1480 | | | 3 | 1480 | polyester double knit, flat | 25 | " | 30 | 135 | fair exhaust, level |
| 25 | 6 | 0.25 | 4 | 5 | 690 | 4 | 0 | 4 | 690 | polyester, woven | 25 | " | 30 | 140 | excel. exhaust, level, strong |
| 26 | 9 | 0.25 | 1 | 6 | 1480 | 1 | 0 | 5 | 1800 | polyester double knit, flat | 25 | " | 30 | 150 | fair exhaust, level |

TABLE 9-continued

| Ex. No. | Dye No. | O.W.F. (wt. %) | Conc. Liq. No. | Cont. Phase No. | Parts (wt.) | Dispersant No. | Carrier No. | * | Parts (wt.) | Polymer | Parts (wt.) | Process | Time (min.) | Temp. (° C.) | Results |
|---|---|---|---|---|---|---|---|---|---|---|---|---|---|---|---|
| 27 | 5 | 0.40 | 1 | 7 | 1475 | 1 | 0 | 6 | 1585 | polyester double knit, flat | 25 | " | 30 | 150 | fair exhaust, level |
| 28 | 6 | 0.25 | 4 | 7 | 1475 | 2 | 0 | 2 | 1550 | cellulose triacetate woven fabric | 25 | flask | 60 | 120 | fair exhaust, level |
| 29 | 14 | 0.25 | 1 | 1 | 1350 | 1 | 0 | 5 | 1800 | cellulose triacetate woven fabric | 24 | " | 60 | 130 | fair exhaust, level |
| 30 | 5 | 0.25 | 2 | 8 | 1500 | 2 | 0 | 7 | 3500 | polyester double knit, flat | 50 | " | 30 | 150 | fair exhaust, level |
| 31 | 3 | 0.50 | 1 | 1 | 1350 | 1 | 0 | 8 | 3500 | polyester double knit, flat | 50 | " | 30 | 135 | fair exhaust, level |
| 32 | 3<br>9 | 0.08<br>0.05 | 1 | 10 | 2100 | 1 | 2 | 1 | 2500 | " | 50 | beam | 30 | 150 | excel. exhaust level, taupe shade |
| 33 | 15 | 0.50 | 6 | 9 | 2260 | 2 | 0 | 1 | 2500 | " | 50 | " | 30 | 135 | excel. exhaust strong, level |
| 34 | 16 | 1.5 | 2 | 10 | 2920 | 2 | 0 | 1 | 3600 | polyamide of 4,4'-methylenebis (cyclohexylamine) and isophthalic acid | 5 | flask | 30 | 135 | strong, excel. exhaust |

* = Fluorocarbon
1 = $F(CF(CF_3)CF_2O)_{6.5\ av.}CF(CF_3)H$
2 = $F(CF(CF_3)CF_2O)_5CF(CF_3)H$
3 = Perfluoro(1-methyldecalin)
4 = Perfluoro(tributylamine)
5 = Perfluorokerosene
6 = $F(CF(CF_3)CF_2O)_4CF(CF_3)H$
7 = $F(CF_2)_{12}Cl$
8 = $C_{8-30}F_{16-60}$ (U.S. 3,403,191)

EXAMPLE 35

This example demonstrates the application to and fixing of a brightening agent on polyester fiber. A concentrate containing the commercially available brightening agent 1,2-bis(2-benzimidazolyl)ethylene was prepared by sand-milling one part by weight of the agent with one part by weight of dispersant No. 2 (Table 7) in about 300 parts by volume of concentrate liquid No. 1 (Table 6), with cooling and replacement of such concentrate liquid as was lost by evaporation. A length (250 parts by weight) of polyester double knit fabric was beam dyed, by a procedure as previously described. Concentrate corresponding to 0.25 part by weight of the agent was diluted to 14,000 parts by volume with 1,1,2-trichloro-1,2,2-trifluoroethane (continuous phase) to form the dispersion. The continuous phase was distillatively removed and replaced with $F(CF(CF_3)CF_2O)_{6.5\ av.}CF(CF_3)H$. A temperature of 120° C. was maintained for 30 minutes. Thereafter the treatment bath was drained and the fabric was rinsed with 1,1,2-trichloro-1,2,2-trifluoroethane and dried. The fabric appeared in ordinary light to be whiter than an untreated sample and, under ultraviolet light, the fabric fluoresced strongly and evenly.

I claim:

1. Non-aqueous, atmospheric pressure, batch exhaust process for applying and fixing a disperse dye or brightening agent on a disperse dyeable synthetic polymer, said process comprising:

a. immersing the polymer in a bath containing a dispersion comprising a liquid, organic continuous phase, a dispersing agent having dispersing activity in the continuous phase and at least one member of the group consisting of disperse dye and brightening agent, said continuous phase being a non-solvent for the dye or brightening agent;

b. distillatively removing the continuous phase from the bath and replacing same, at a rate which is volumetrically proportional to the rate of removal of the continuous phase, with a liquid fluorocarbon which is miscible with the continuous phase and has a fluorine to carbon atom ratio of at least 1.5, a solubility parameter of no greater than 6.5 and a boiling point at 760 mm. pressure at least as high as the glass transition temperature of the polymer and at least 10° C. higher than that of the continuous phase;

c. heating the polymer, in the presence of the liquid fluorocarbon, to at least its glass transition temperature and maintaining it at this temperature until the dye or agent is fixed on the polymer; and d. recovering polymer having dye or agent fixed thereon.

2. Process of claim 1 wherein the polymer is a polyamide.

3. Process of claim 1 wherein the polymer is a polyester.

4. Process of claim 3 wherein the polyester is a polyethylene terephthalate.

5. Process of claim 1 wherein there is employed a dye.

6. Process of claim 1 wherein there is employed a brightening agent.

7. Process of claim 1 wherein the solubility parameter of the continuous phase is 7.0 – 8.2.

8. Process of claim 7 wherein the continuous phase is 1,1,2-trichloro-1,2,2-trifluoroethane.

9. Process of claim 1 wherein the liquid fluorocarbon has a solubility parameter of 5.5 – 6.5 and is of the formula $F[CF(CF_3)CF_2O]_nCHFCF_3$ wherein $n$ is at least 3.

10. Process of claim 9 wherein $n$ is 6.5, average.

11. Process of claim 5 wherein the dye is a disperse dye.

12. Process of claim 5 wherein there is employed a dye carrier.

13. Process of claim 5 wherein there is employed a dyeing accelerator.

* * * * *